US010168652B2

(12) United States Patent
Miyawaki

(10) Patent No.: US 10,168,652 B2
(45) Date of Patent: Jan. 1, 2019

(54) ROLLER UNIT AND IMAGE FORMING APPARATUS

(71) Applicant: FUJI XEROX CO., LTD., Tokyo (JP)

(72) Inventor: Satoshi Miyawaki, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 2 days.

(21) Appl. No.: 15/716,735

(22) Filed: Sep. 27, 2017

(65) Prior Publication Data

US 2018/0246446 A1 Aug. 30, 2018

(30) Foreign Application Priority Data

Feb. 27, 2017 (JP) ..... 2017-035127

(51) Int. Cl.

| | |
|---|---|
| ***G03G 15/02*** | (2006.01) |
| ***G03G 15/20*** | (2006.01) |
| ***G03G 15/01*** | (2006.01) |
| ***G03G 15/00*** | (2006.01) |

(52) U.S. Cl.

CPC ..... *G03G 15/2053* (2013.01); *G03G 15/0131* (2013.01); *G03G 15/6529* (2013.01); *G03G 2221/1642* (2013.01)

(58) Field of Classification Search

USPC ..... 399/107, 110, 111, 116, 117, 119, 121, 399/167, 168, 174, 176

See application file for complete search history.

(56) References Cited

U.S. PATENT DOCUMENTS 6,522,848 B2 * 2/2003 Wakana ..... G03G 15/167 399/110
2013/0051858 A1 * 2/2013 Mukaiyama ..... G03G 15/751 399/222

FOREIGN PATENT DOCUMENTS

JP 2010-262215 A 11/2010
JP 2016-090793 A 5/2016

* cited by examiner

*Primary Examiner* — Hoan Tran
(74) *Attorney, Agent, or Firm* — Sughrue Mion, PLLC

(57) ABSTRACT

A roller unit includes: a first roller including, at one end, a shaft having a cut-out portion; a bearing that supports the shaft and forms a space for accommodating an object disposed in the cut-out portion; and a switching member including a shaft part that can be disposed in the cut-out portion, and a separating part that is continuous with the shaft part and that, when the shaft part is disposed in the cut-out portion, comes into contact with a unit including a second roller to separate the first and second roller. When the shaft part rotates with the shaft and moves from the cut-out portion to the space, the separating part comes out of contact with the unit, bringing the first roller and the second roller into a state in which the first roller and the second roller push each other.

13 Claims, 12 Drawing Sheets

ROLLER UNIT AND IMAGE FORMING APPARATUS

CROSS-REFERENCE TO RELATED APPLICATIONS

This application is based on and claims priority under 35 USC 119 from Japanese Patent Application No. 2017-035127 filed Feb. 27, 2017.

BACKGROUND

Technical Field

The present invention relates to a roller unit and an image forming apparatus.

SUMMARY

According to an aspect of the invention, there is provided a roller unit including: a first roller including, at one end, a shaft having a cut-out portion; a bearing that supports the shaft and forms a space for accommodating an object disposed in the cut-out portion; and a switching member including a shaft part that can be disposed in the cut-out portion, and a separating part that is continuous with the shaft part and that, when the shaft part is disposed in the cut-out portion, comes into contact with a unit including a second roller to separate the first and second roller. When the shaft part rotates with the shaft and moves from the cut-out portion to the space, the separating part comes out of contact with the unit, bringing the first roller and the second roller into a state in which the first roller and the second roller push each other.

BRIEF DESCRIPTION OF THE DRAWINGS

Exemplary embodiment of the present invention will be described in detail based on the following figures, wherein.

DETAILED DESCRIPTION

1. Example

Figure 1:
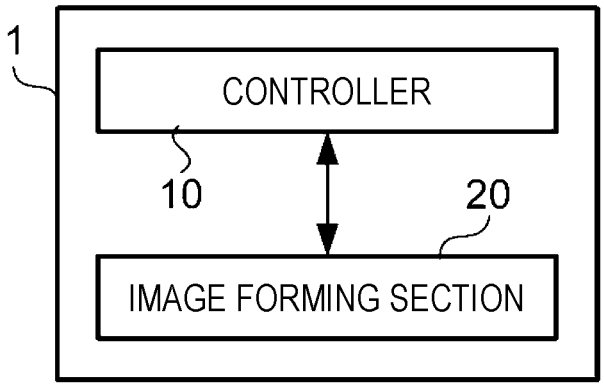
FIG. 1 shows the overall configuration of an image forming apparatus according to an example.

FIG. 1 shows the overall configuration of an image forming apparatus 1 according to an example. The image forming apparatus 1 forms a color image on a medium with an electrophotographic system. The image forming apparatus 1 includes a controller 10 and an image forming section 20. The controller 10 is connected to an external device by a communication line (not shown). When image data is transmitted from the external device, the controller 10 converts the image data from, for example, RGB color image data to CMYK color image data. The controller 10 then outputs the processed image data to the image forming section 20.

The image forming section 20 forms, on a medium, an image represented by the image data processed by the controller 10. The image forming section 20 forms a color image by fixing four toners, namely, yellow (Y), magenta (M), cyan (C), and black (K) toners, on the medium.

Figure 2:
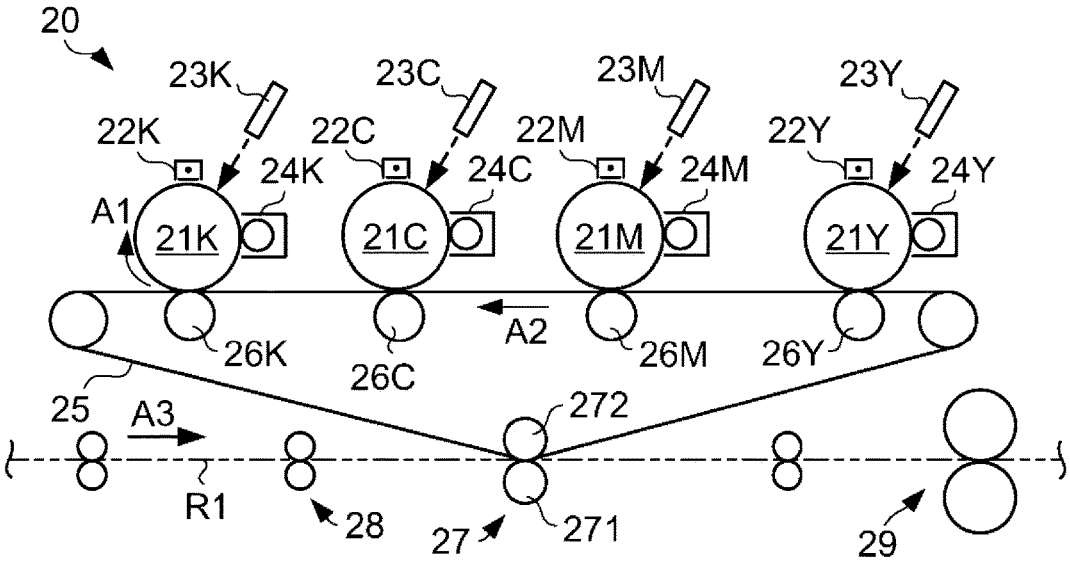
FIG. 2 shows a hardware configuration of an image forming section.

FIG. 2 shows a hardware configuration of the image forming section 20. The image forming section 20 includes photoconducting parts 21, charging parts 22, exposure parts 23, developing parts 24, first transfer parts 26, an intermediate transfer belt 25, a second transfer part 27, a transport part 28, and a fixing part 29.

The photoconducting part 21, the charging part 22, the exposure part 23, the developing part 24, and the first transfer part 26 are provided for each of the Y, M, C, K colors, and the sets of these parts are arranged along the intermediate transfer belt 25. In FIG. 2, the letter Y, M, C, or K is suffixed to the reference signs of these parts to indicate that these parts are used to form an image of the corresponding color. When these parts do not need to be distinguished from one another or when these parts are collectively mentioned, the suffixed letters will be omitted.

The photoconducting part 21 is provided for each color and is a unit including a photoconductor drum 211 on which an image formed with toner is held. The photoconductor drum 211 is an example of "a second roller" of the present invention, and the photoconducting part 21 is an example of "a unit including the second roller" in the present invention. The photoconductor drum 211 has a photosensitive layer. The photoconductor drum 211 holds, on the photosensitive layer surface, a latent image (or an "electrostatic latent image") and an image formed by developing the latent image with toner, while rotating in a rotation direction A1.

The charging part 22 charges the photosensitive layer of the photoconducting part 21 such that the surface has a predetermined electric potential. The exposure part 23 exposes the photosensitive layer by irradiating the charged photosensitive layer with exposure light. The intensity and irradiation positions of the exposure light are controlled according to the image data. As a result, a latent image of the image indicated by the image data is formed on the photoconductor drum 211.

The developing part 24 includes a developing roller that attracts and transports charged toner. The developing part 24 develops the latent image by applying a developing bias voltage to the photoconducting part 21 and the developing roller to supply the toner from the developing roller to the photoconducting part 21. In this way, the developing part 24 forms a visible image with the toner on the portion where the latent image is formed.

The intermediate transfer belt 25 is an endless belt and holds images first-transferred from the respective photoconducting parts 21. The intermediate transfer belt 25 is an example of a "transfer belt" of the present invention. The intermediate transfer belt 25 is supported by multiple support rollers in a revolvable manner and is revolved in a revolving direction A2 by a driving force supplied thereto.

The Y, M, C, and K color images are sequentially first-transferred to the intermediate transfer belt 25 from the photoconducting part 21.

The first transfer parts 26 each include a first transfer roller 260 provided so as to oppose the photoconducting part 21 with the intermediate transfer belt 25 therebetween. The photoconducting part 21 is urged toward the corresponding first transfer part 26 by an urging part, such as a spring, and thus, the first transfer roller 260 and the photoconductor drum 211 rotate in a pressed state, that is, in a state in which they apply pressure to each other (note that, even though the first transfer roller 260 and the photoconductor drum 211 are in a pressed state, they are not in direct contact with each other because of the intermediate transfer belt 25 therebetween).

In the pressed state, the intermediate transfer belt 25 revolves while being nipped between the first transfer rollers 260 and the photoconductor drums 211. When first transfer voltages are applied to the first transfer rollers 260 and the photoconductor drums 211 in the pressed state, the images held on the photoconductor drums 211 are first-transferred to the intermediate transfer belt 25. The first transfer rollers 260 are an example of "first rollers" of the present invention, and the first transfer parts 26 are an example of "roller units" of the present invention.

The second transfer part 27 includes a second transfer roller 271 and a backup roller 272. The second transfer roller 271 and the backup roller 272 are provided so as to oppose each other and form a nip with the intermediate transfer belt 25 therebetween. When a second transfer voltage is applied between the second transfer roller 271 and the backup roller 272, the image held on the intermediate transfer belt 25 is second-transferred to a medium that passes through the nip. The transport part 28 includes multiple rollers and transports the medium in a transport direction A3, along a transport path R1 extending through the nip. The medium transported by the transport part 28 comes into contact with the intermediate transfer belt 25. The fixing part 29 fixes, to the medium, the image second-transferred to the medium.

As has been described above, the charging parts 22, the exposure parts 23, the developing parts 24, the second transfer part 27, the transport part 28, and the fixing part 29 form an image by forming images on the photoconductor drums 211, transferring the formed images to the intermediate transfer belt 25 by applying first transfer voltages to the photoconductor drums 211 and the first transfer rollers 260, and transferring the images transferred to the intermediate transfer belt 25 to a medium. They are an example of an "image forming section" of the present invention.

When the image forming apparatus 1 is produced, the first transfer rollers 260 and the photoconductor drums 211 are set to a separated state (i.e., a state in which they are separated from each other and do not apply pressure to each other). If the first transfer rollers 260 and the photoconductor drums 211 are in a pressed state (i.e., a state in which they apply pressure to each other), the first transfer rollers 260 and the photoconductor drums 211 may be deformed, contaminated, or may rub each other. Hence, the image forming apparatus 1 is dispatched with the first transfer rollers 260 and the photoconductor drums 211 being in the separated state, and, when a user starts using the image forming apparatus 1, the user switches the state from the separated state to the pressed state. The configuration related to this switching operation will be described below with reference to the drawings.

Figure 3A:
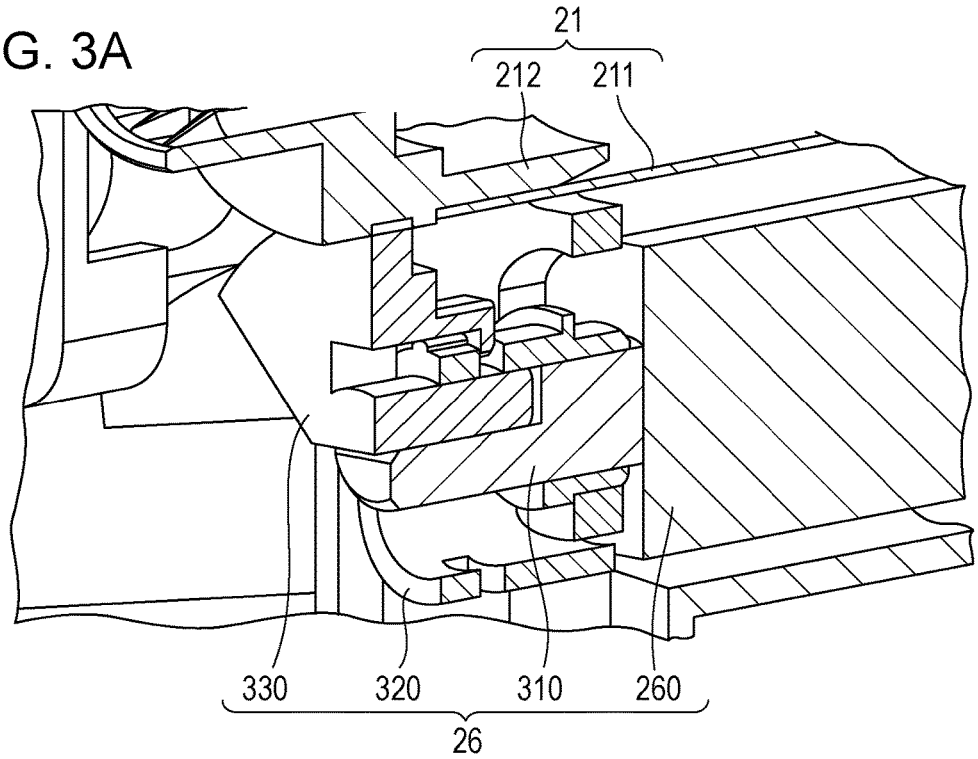
FIGS. 3A and 3B show a photoconducting part and a first transfer part in a separated state.
Figure 3B:
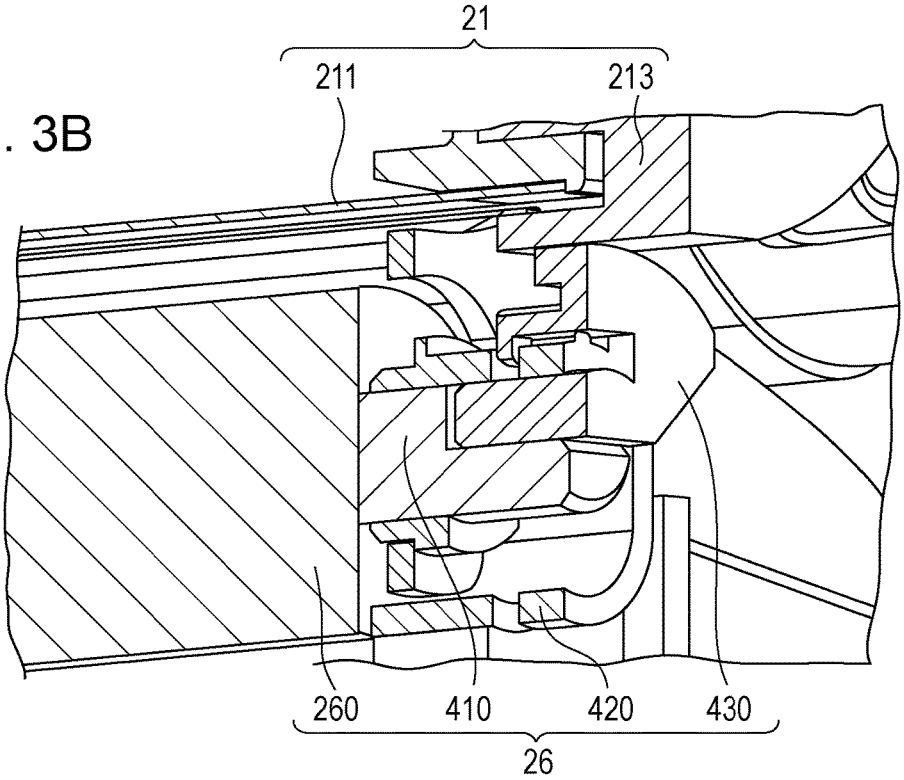

FIGS. 3A and 3B show the photoconducting part 21 and the first transfer part 26 in the separated state. FIG. 3A shows one end of the first transfer roller 260 of one first transfer part 26, and FIG. 3B shows the other end of the first transfer roller 260. Hereinbelow, "one end" refers to one end of the first transfer roller 260 as shown in FIG. 3A, and "the other end" refers to the other end of the first transfer roller 260 as shown in FIG. 3B.

Each photoconducting part 21 includes the photoconductor drum 211, a drum gear 212 at one end, and a drum gear 213 at the other end. The drum gears 212 and 213 are rotated by power transmitted from a driving part that generates a driving force for rotating the photoconductor drum 211. The radii at the tips of the teeth of the drum gears 212 and 213 are equal to the radius of the photoconductor drum 211.

Each first transfer part 26 includes, at one end of the transfer roller 260, a first shaft 310, a first bearing 320, and a first switching member 330 and, at the other end of the transfer roller 260, a second shaft 410, a second bearing 420, and a second switching member 430, which are symmetrical in shape to the first shaft 310, the first bearing 320, and the first switching member 330 with respect to a direction perpendicular to the axial direction of the first transfer roller 260. Although the shapes of the first shaft 310, the first bearing 320, and the first switching member 330 at one end are symmetrical to the second shaft 410, the second bearing 420, and the second switching member 430 at the other end, their sizes and functions are the same. Hence, the description about one end given below also applies to the other end.

Figure 4A:
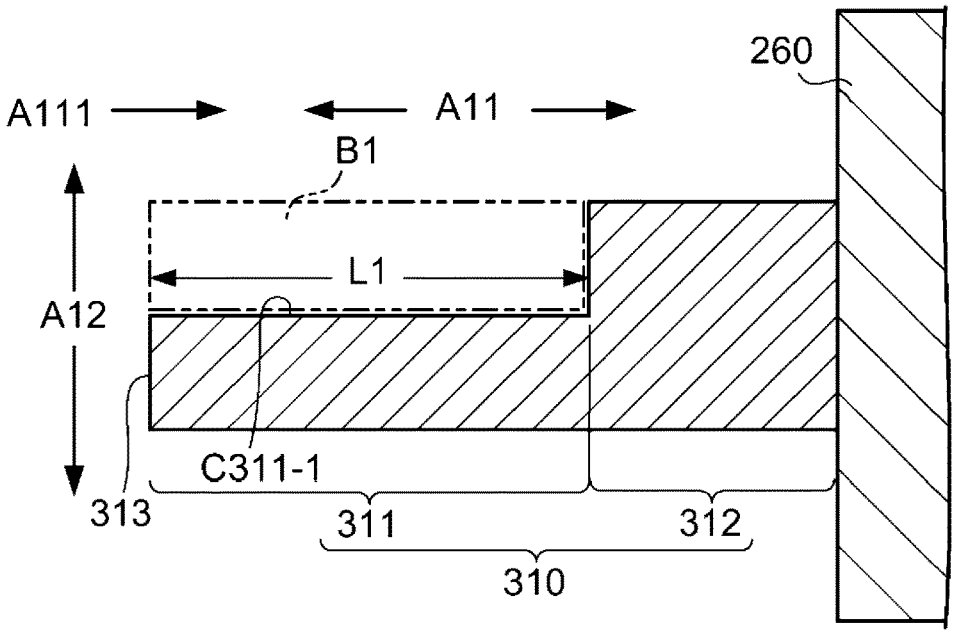
FIGS. 4A and 4B show a first shaft.
Figure 4B:
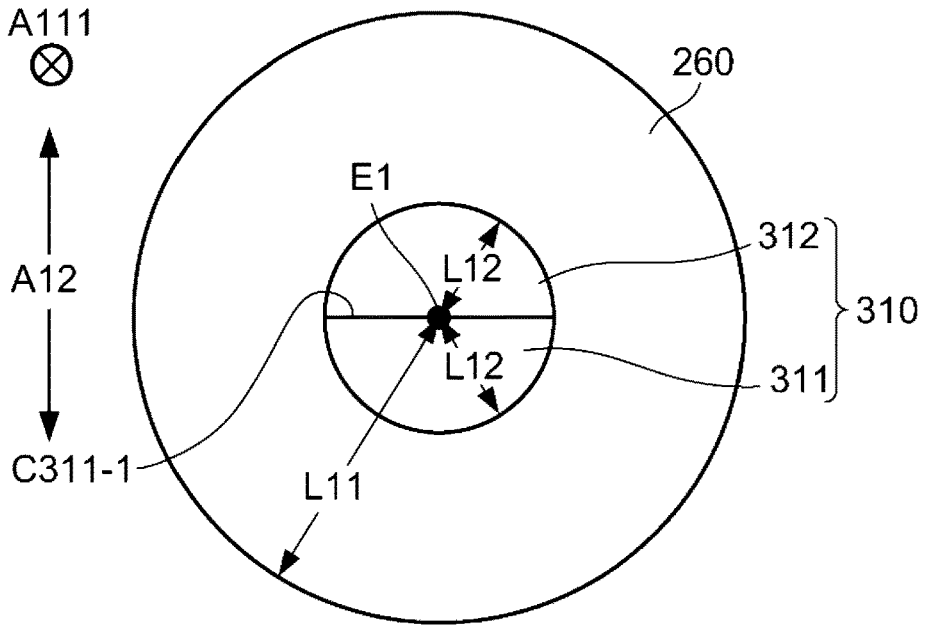

FIGS. 4A and 4B show the first shaft 310. FIGS. 4A and 4B show: an axial direction A11, which is a direction parallel to the rotation axis of the first shaft 310; an inward direction A111 extending from the distal-end side of the first shaft 310 toward the first transfer roller 260, along the axial direction A11; and a vertical direction A12. The image forming apparatus 1 is used such that the axial direction A11 is parallel to the horizontal direction. Hence, also in other diagrams, the axial direction A11 represents the horizontal direction. FIG. 4A is a sectional shape of the first shaft 310, as viewed from a direction perpendicular to the axial direction A11 and parallel to the horizontal direction, and FIG. 4B shows the first shaft 310 as viewed in the inward direction A111.

The first shaft 310 has a cut-out portion B1. The first shaft 310 includes a cut-out part 311, which is a portion with the cut-out portion B1, and a cylindrical part 312, which is a portion without the cut-out portion. The cut-out portion B1 is formed by cutting away a portion at a distal end 313 (i.e., the end opposite to the end continuous with the first transfer roller 260) of the first shaft 310 by D-cutting.

The cut-out part 311 is formed by D-cutting and has a length L1 from the distal end 313. The cut-out part 311 has a semicylindrical shape (a shape obtained by cutting a cylinder in half along a plane extending through the rotation axis) and has a flat cut surface C311-1 extending through a rotation axis E1 of the first shaft 310. Therefore, the cut-out portion B1 is a semicylindrical space having the cut surface C311-1 serving as a boundary and having a length in the axial direction A11 of L1.

The cylindrical part 312 is a portion of the first shaft 310 on the first transfer roller 260 side (i.e., a portion attached to the first transfer roller 260) and has a cylindrical shape having a radius L12, which is smaller than the radius L11 of the first transfer roller 260. The radius of the cut-out portion B1, which is formed by cutting the cylinder until the cut surface C311-1 extending through the rotation axis E1 is formed, is also L12.

Figure 5A:
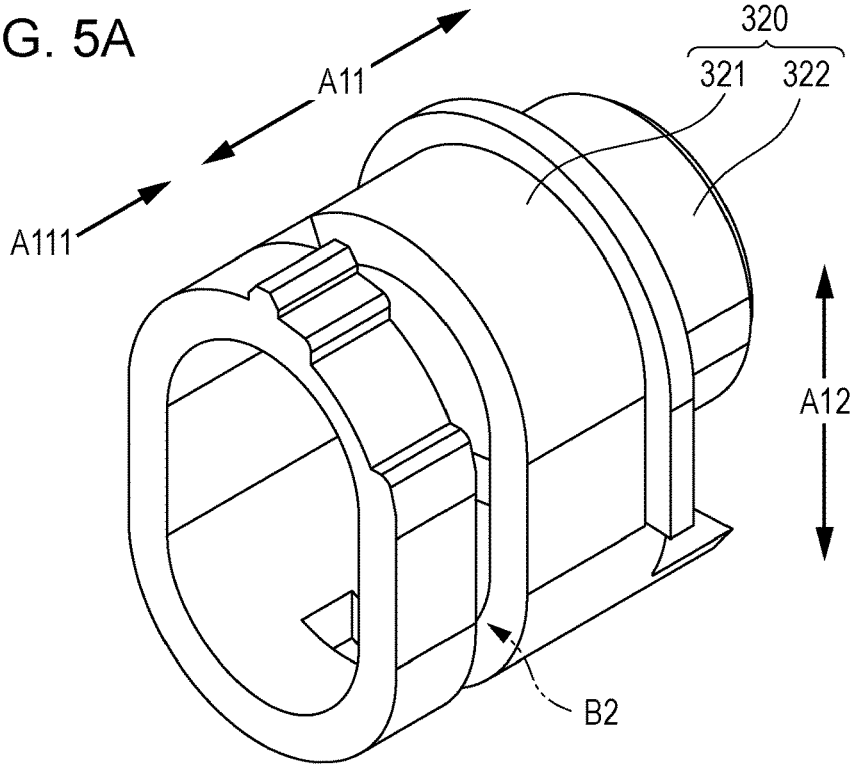
FIGS. 5A and 5B show the exterior of a first bearing.
Figure 5B:
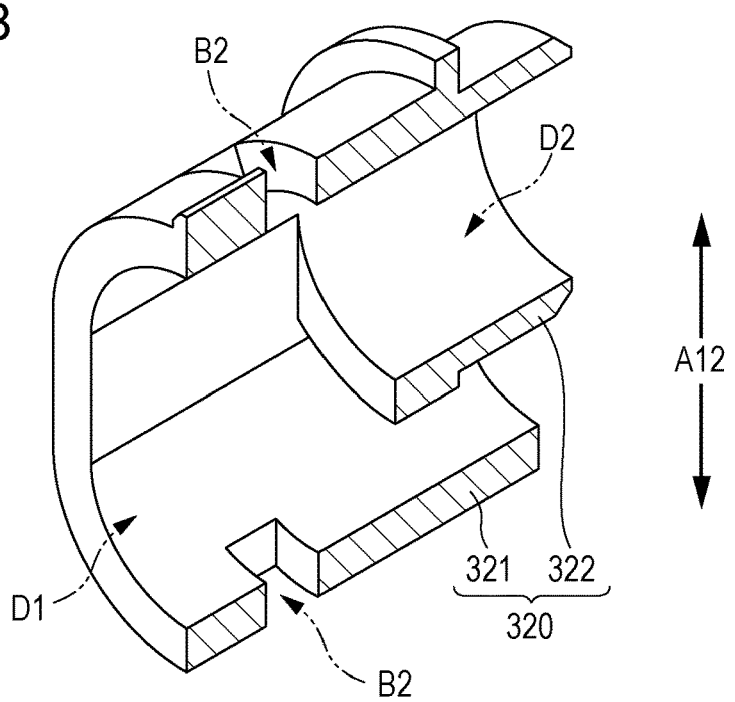

FIGS. 5A and 5B show the exterior of the first bearing 320. FIGS. 5A and 5B show the axial direction A11, which is parallel to the horizontal direction when the first shaft 310 is inserted into the first bearing 320, the inward direction A111, and the vertical direction A12. FIG. 5A shows the entirety of the first bearing 320, and FIG. 5B shows the first bearing 320 cut in half along a plane parallel to the vertical direction A12.

The first bearing 320 supports the first shaft 310 so as to allow rotation. The first bearing 320 includes a first support part 321 that supports the cut-out part 311 and a second support part 322 that supports the cylindrical part 312 when the first shaft 310 is inserted therein. The second support part 322 of the first bearing 320 is a cylindrical portion having, inside thereof, a cylindrical space D2 for accommodating the cylindrical part 312. The first bearing 320 is a plain bearing that supports the load from the first shaft 310 primarily with the inner surface of the cylindrical part 312.

The first support part 321 of the first bearing 320 has, inside thereof, a space D1, which has a shape obtained by expanding, in the vertical direction A12, a cylindrical space identical to the space D2. The space D2 will be described in detail below with reference to FIGS. 6A and 6B.

Figure 6A:
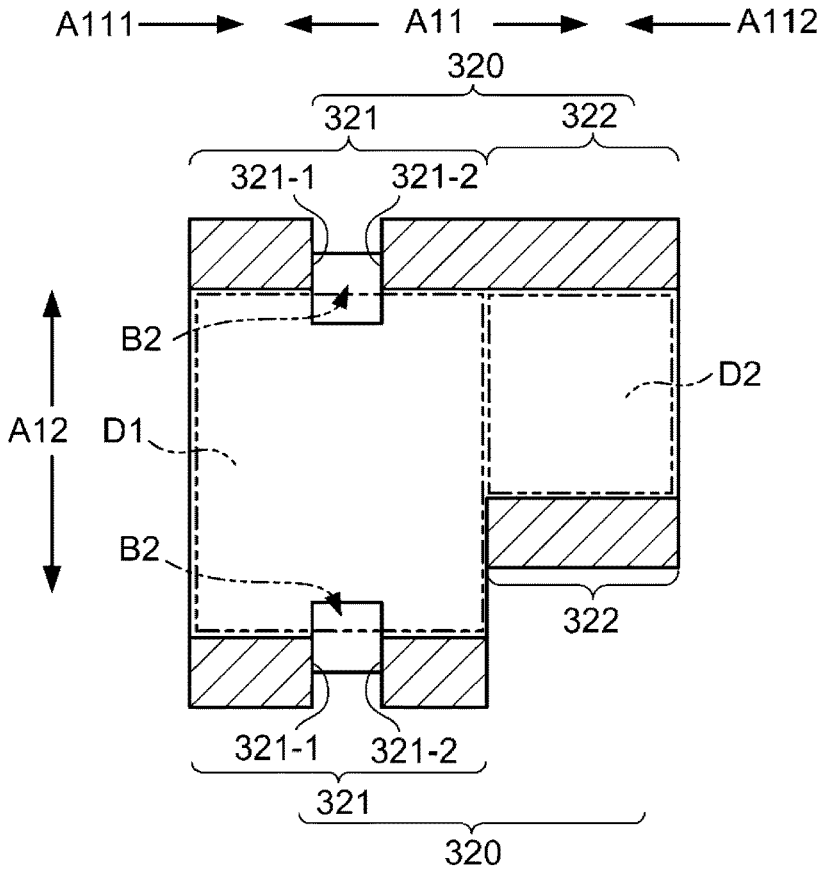
FIGS. 6A and 6B show the first bearing viewed from two sides.
Figure 6B:
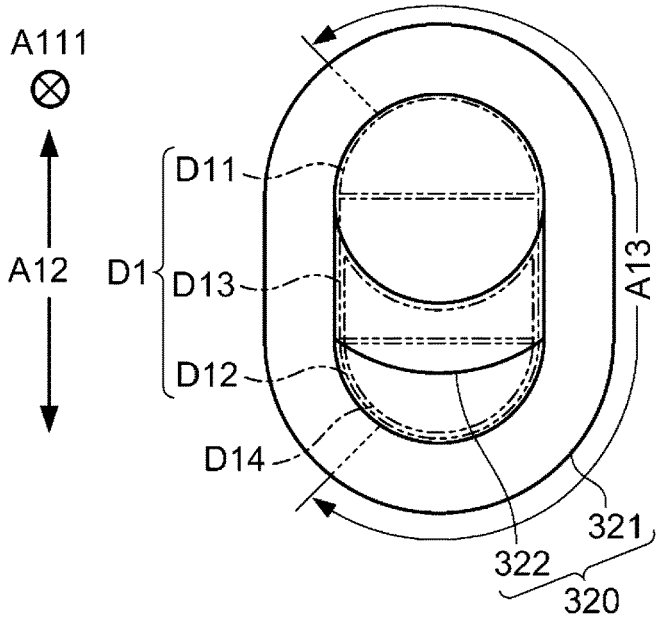

FIGS. 6A and 6B show the first bearing 320 viewed from two sides. FIG. 6A is a sectional view of the first bearing 320, as viewed from a direction perpendicular to the axial direction A11 and parallel to the horizontal direction, and FIG. 6B shows the first bearing 320 as viewed in the inward direction A111.

The space D1 has a shape formed by combining the semicylindrical spaces D11 and D12 and a rectangular parallelepiped space D13, which is formed between the semicylindrical spaces D11 and D12 when the semicylindrical spaces D11 and D12 formed by dividing a cylinder along a plane extending through the rotation axis are spaced apart with their cut surfaces facing each other.

When the first support part 321 forms the space D1, the first bearing 320 forms a storage space D14 for storing an object that can be disposed in the cut-out portion B1, in a predetermined direction (in the example of FIGS. 6A and 6B, a vertically downward direction) with respect to the cut-out part 311. The object that can be disposed in the cut-out portion B1 is a portion of the first switching member 330 (described below). The storage space D14 is obtained by removing, from the space D1, a space through which the cut-out part 311, which rotates, passes (i.e., a cylindrical space located vertically above the space D1).

The first support part 321 has a slit B2. The slit B2 extends in the circumferential direction and is provided in the outer circumferential surface of the first support part 321, in an area including the upper end (vertically upper end) and the lower end (vertically lower end) (i.e., a range indicated by arrow A13 in FIG. 6B). The slit B2 extends to the inner circumferential surface of the first support part 321. The first bearing 320 has, on the outer side of the slit B2 in the axial direction A11, an inward surface 321-1 facing the inward direction A111 and has, on the inner side of the slit B2 in the axial direction A11, an outward surface 321-2 facing the outward direction A112, which is opposite to the inward direction A111. The inward surface 321-1 and the outward surface 321-2 form the slit B2. A portion of the first switching member 330 (described below) is inserted into the slit B2.

Figure 7A:
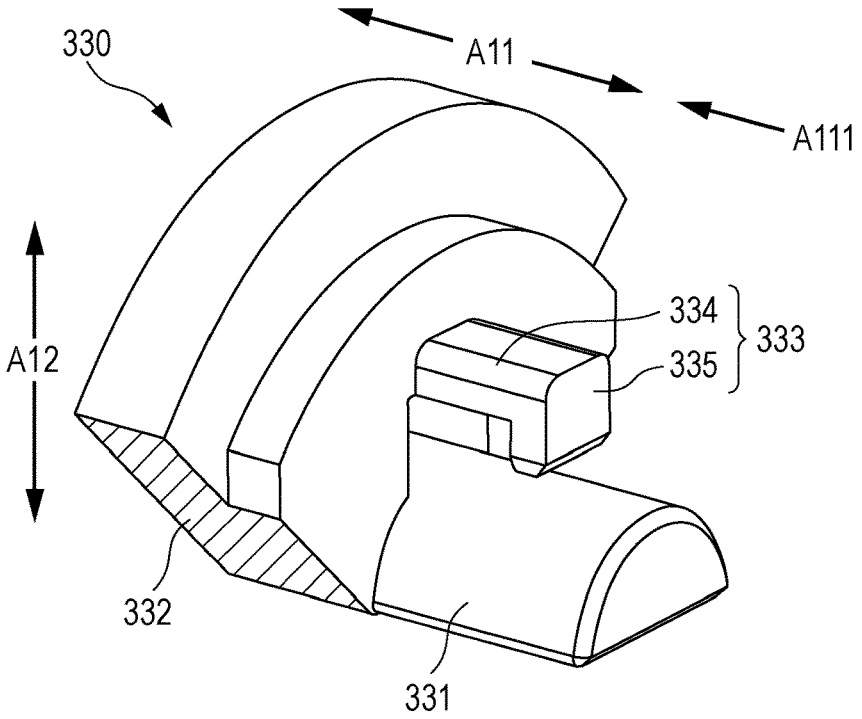
FIGS. 7A and 7B show the exterior of a first switching member.
Figure 7B:
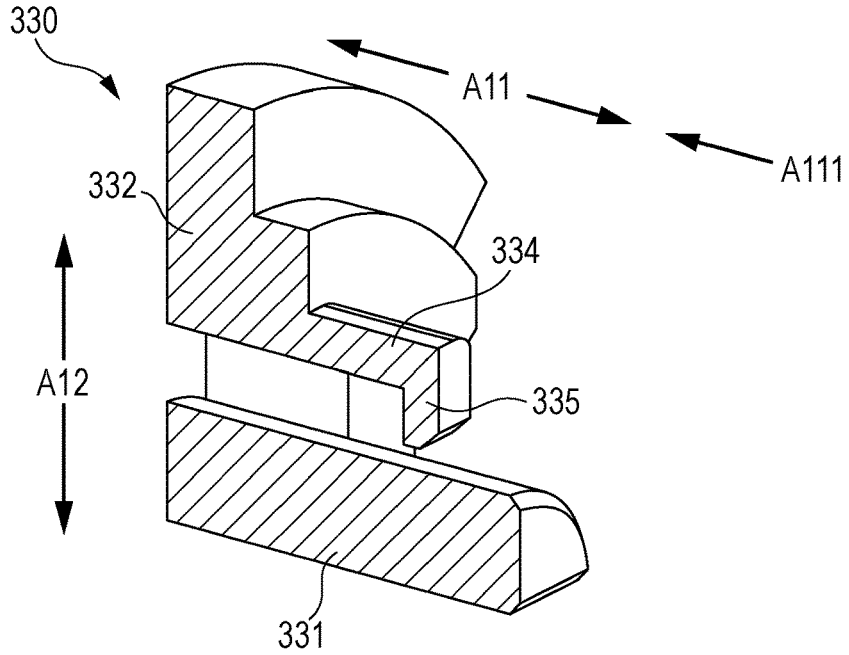

FIGS. 7A and 7B show the exterior of the first switching member 330. FIGS. 7A and 7B show the axial direction A11 parallel to the horizontal direction, the inward direction A111, and the vertical direction A12 when the first switching member 330 brings the first transfer roller 260 and the photoconductor drum 211 into a separated state. FIG. 7A shows the entirety of the first switching member 330, and FIG. 7B shows the first switching member 330 that is cut in half along a plane parallel to the vertical direction A12.

The first switching member 330 switches the state of the first transfer roller 260 and the photoconductor drum 211 from a separated state, in which they are spaced apart, to a pressed state, in which they press each other. The first switching member 330 is an example of a "switching member" in the present invention. The first switching member 330 includes a first shaft part 331, a first separating part 332, and a first arm part 333. The first arm part 333 is an L-shaped rod-like part including a rod-like longitudinal portion 334, which is a longer portion, and a rod-like hook portion 335, which is a shorter portion. The shapes and sizes of these portions will be described in detail below with reference to FIGS. 8A to 8C.

Figure 8A:
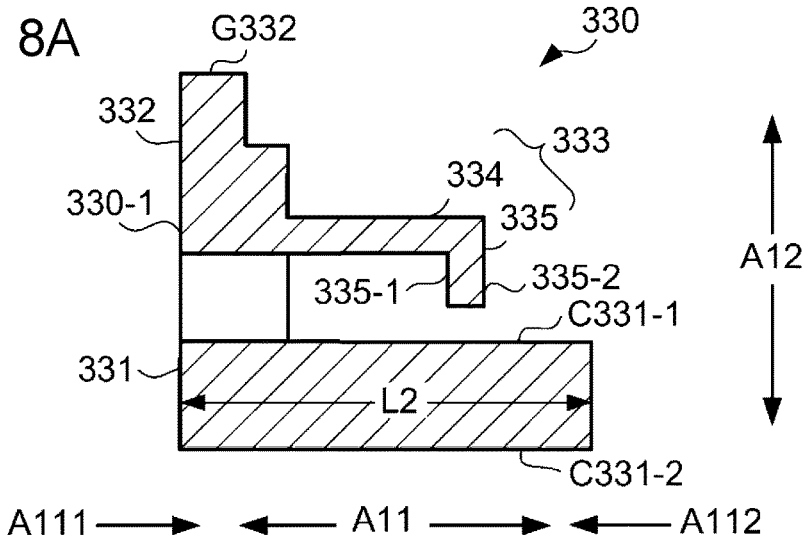
FIGS. 8A to 8C show the first switching member viewed from two sides.
Figure 8B:
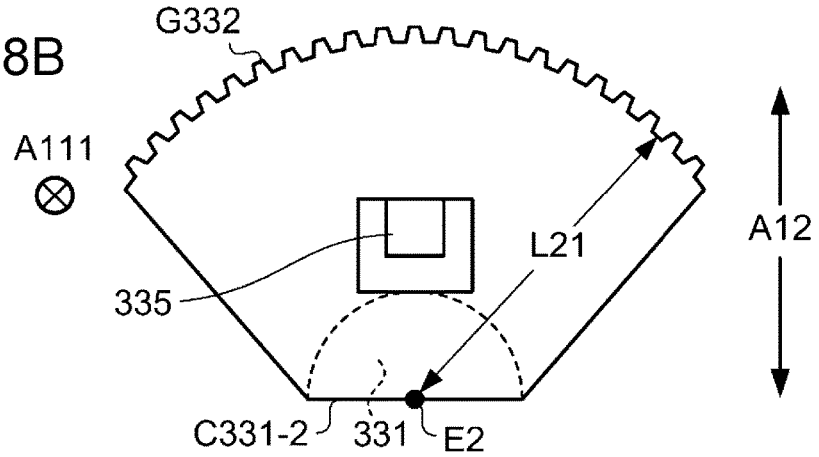
Figure 8C:
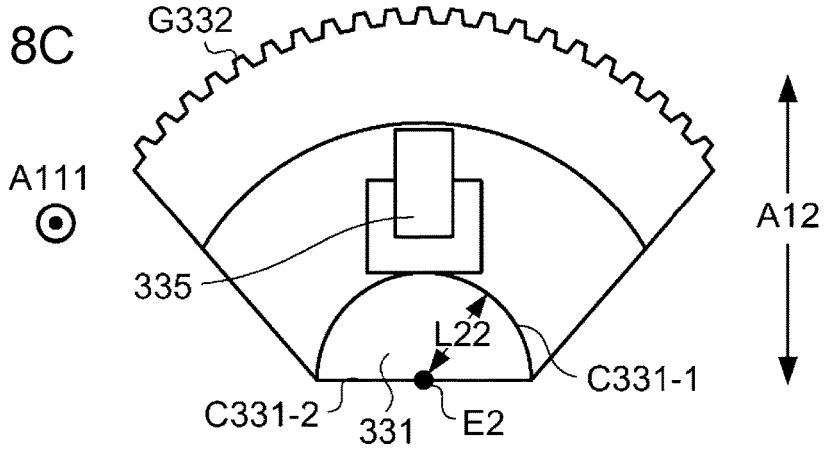

FIGS. 8A to 8C show the first switching member 330 viewed from two sides. FIGS. 8A to 8C show, similarly to FIGS. 7A and 7B, the axial direction A11, the inward direction A111, and the vertical direction A12. FIG. 8A is a sectional view of the first switching member 330 as viewed from a direction perpendicular to the axial direction A11 and parallel to the horizontal direction, FIG. 8B shows the first switching member 330 as viewed in the inward direction A111, and FIG. 8C shows the first switching member 330 as viewed from the inward direction A111.

The first shaft part 331 is formed in a semicylindrical shape and has an arc-shaped outer circumferential surface C331-1, and a cut surface C331-2 corresponding to a cut surface extending through a rotation axis E2 of a cylinder. The radius L22 of the first shaft part 331 is equal to the radius L 12 of the cut-out part 311 and the cut-out portion B1 of the first shaft 310. Furthermore, the length L2 of the first shaft part 331 in the axial direction A11 is equal to the length L1 of the cut-out portion B1 in the axial direction A11. Hence, the first shaft part 331 is sized and shaped so as to fit in the cut-out portion B1 (so as not to protrude from the cut-out portion B1) and serves as an object that can be disposed in the cut-out portion B1.

The first separating part 332 is a plate-like part having a shape obtained by removing a smaller circular sector from the center of a larger circular sector. The first shaft part 331 is connected to the smaller arc portion of the first separating part 332. The first separating part 332 has a gear portion G332 on the edge opposite to the edge connected to the first shaft part 331. The gear portion G332 has multiple teeth arranged in an arc shape and has an arc shape as a whole. That is, the first separating part 332 has the shape of a partially toothless gear in which some teeth of the gear are lost.

Note that, in the figures other than FIGS. 8A to 8C, the teeth of the gear portion G332 are not illustrated to simplify the figures. The teeth of the gear portion G332 are shaped and sized so as to mesh with the teeth of the drum gear 212, as shown in FIG. 3A. The radius L21 at the bottoms of the teeth of the gear portion G332 is larger than the radius L11 of the first transfer roller 260 shown in FIG. 4B. The rotation axis E2 of the first shaft part 331 also serves as the center of the arc in the gear portion G332.

In a state in which the longitudinal direction is parallel to the axial direction A11, the longitudinal portion 334 of the first arm part 333 is continuous with the first separating part 332 at one end and with the hook portion 335 at the other end. One end of the hook portion 335 opposite to the end continuous with the longitudinal portion 334 (i.e., the distal end of the first arm part 333) faces the first shaft part 331. The hook portion 335 is provided on the inner side, in the axial direction A11, of an end surface 330-1 of the first switching member 330 facing outward of the axial direction A11 and includes an outward surface 335-1 facing the outward direction A112 (outward of the axial direction A11) and an inward surface 335-2 facing the inward direction A111.

Figure 9:
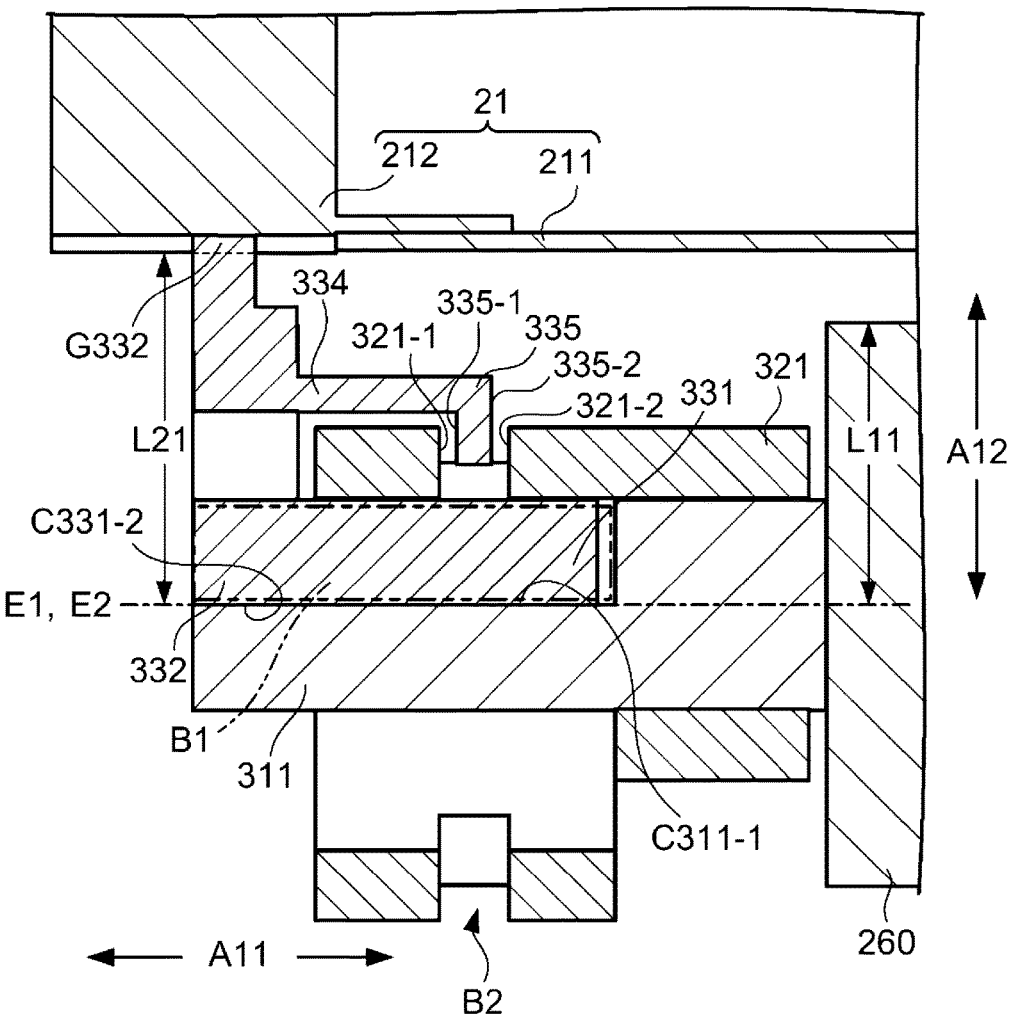
FIG. 9 is a sectional view of the photoconducting part and the first transfer part in a separated state.

FIG. 9 is a sectional view of the photoconducting part 21 and the first transfer part 26 in a separated state. FIG. 9 shows the axial direction A11 parallel to the horizontal direction and the vertical direction A12. As shown in FIG. 9, in the separated state, the photoconductor drum 211 is located vertically above the first transfer roller 260. The first shaft 310 remains stationary with the cut-out portion B1 being located on the vertically upper side, that is, on the photoconductor drum 211 side.

The first shaft part 331 of the first switching member 330 is disposed in the cut-out portion B1, which is located on the photoconductor drum 211 side. More specifically, when the first shaft part 331 is inserted into a space between the cut-out part 311 of the first shaft 310 and the first support part 321 of the first bearing 320, the cut surface C331-2 comes into contact with the cut surface C311-1 of the first shaft 310, and thus, the first shaft part 331 and the cut-out part 311 of the first shaft 310 form a cylindrical shape. The cut surface C331-2 is a surface that comes into contact with the first shaft 310 when the first shaft part 331 is disposed in the cut-out portion B1.

When the first shaft part 331 is disposed in the above-described manner, the first separating part 332 of the first switching member 330 comes into contact with the photoconducting part 21 (more specifically, the drum gear 212) and separates the first transfer roller 260 and the photoconductor drum 211. When the first shaft part 331 is disposed in the above-described manner, the gear portion G332 of the first separating part 332 is located on the vertically upper side. The first separating part 332 supports the photoconducting part 21 from vertically below, with the gear portion G332 and the drum gear 212 meshing with each other.

As described above, the radius L21 at the bottoms of the teeth of the gear portion G332 is larger than the radius L11 of the first transfer roller 260. In the photoconducting part 21, the radius at the tips of the teeth of the drum gear 212 is equal to the radius of the photoconductor drum 211. Hence, when the rotation axis E1 of the first transfer roller 260 and the rotation axis E2 of the first shaft part 331 overlap, the distance between the rotation axis E1 and the photoconductor drum 211 is L21. Hence, the first transfer roller 260, which has a radius smaller than L21, is separated from the photoconductor drum 211.

As described above, the first separating part 332 comes into contact with the photoconducting part 21 (more specifically, the drum gear 212) at the arc-shaped portion thereof (i.e., gear portion G332) centered at the axis common to the axis of the first shaft 310 to separate the first transfer roller 260 and the photoconductor drum 211. In the separated state, the first shaft 310 (more specifically, the cut-out part 311) is disposed at the opposite side of the first separating part 332 from the photoconducting part 21. With this configuration, the first shaft 310 supports the load applied from the photoconducting part 21 to the first separating part 332, and thus, the bending moment generated in the first shaft part 331 is smaller than that in the case where the first separating part 332 is not provided in the vertical direction A12 of the cut-out part 311.

When the first shaft part 331 is disposed as above, the hook portion 335 of the first arm part 333 is inserted in the slit B2 in the first bearing 320. As a result, the first separating part 332 and the hook portion 335 sandwich the first support part 321 of the first bearing 320 therebetween in the axial direction A11, and the longitudinal portion 334 of the first arm part 333 and the first shaft part 331 sandwich the first support part 321 therebetween in the vertical direction A12.

The hook portion 335 has the outward surface 335-1. The first bearing 320 has the inward surface 321-1 facing the inward direction A111. In the separated state in FIG. 9, the inward surface 321-1 faces the outward surface 335-1 of the hook portion 335. When the first shaft part 331 is disposed in the above-described manner, the first switching member 330 is movable relative to the first bearing 320 and the first shaft 310 in the axial direction A11.

In the separated state, the first switching member 330 is in contact with the photoconducting part 21 and the first shaft 310 and is inhibited from moving in the axial direction A11 due to the friction. However, if a strong force is applied, the first switching member 330 may move in the axial direction A11. In that case, if the first switching member 330 moves in the outward direction A112, the outward surface 335-1 of the hook portion 335 and the inward surface 321-1 of the first bearing 320 come into contact with each other and prevent further movement of the first switching member 330 in the outward direction A112. The outward surface 335-1 is an example of a "first surface" of the present invention, and the inward surface 321-1 is an example of a "second surface" of the present invention.

When the image forming apparatus 1 is produced in a factory, for example, a worker arranges the first switching member 330 and the second switching member 430 as shown in FIG. 9 to separate the first transfer roller 260 and the photoconductor drum 211. Then, the image forming apparatus 1 is dispatched. In this task before dispatching, as shown in FIG. 9, it is desirable that the first switching member 330 be disposed such that a space is produced between the outward surface 335-1 of the hook portion 335 and the inward surface 321-1 of the first bearing 320, in other words, such that the outward surface 335-1 and the inward surface 321-1 do not touch each other.

It is also desirable that first switching member 330 be disposed such that a space is produced between the inward surface 335-2 of the hook portion 335 and the outward surface 321-2 of the first bearing 320, in other words, such that the inward surface 335-2 and the outward surface 321-2 do not touch each other. When a user turns on the power of the image forming apparatus 1, the driving part is actuated and rotates the drum gear 212, the drum gear 213, and the photoconductor drum 211. As a result, the first switching member 330 and the second switching member 430 also rotate, and the separated state is switched to the pressed state.

Figure 10A:
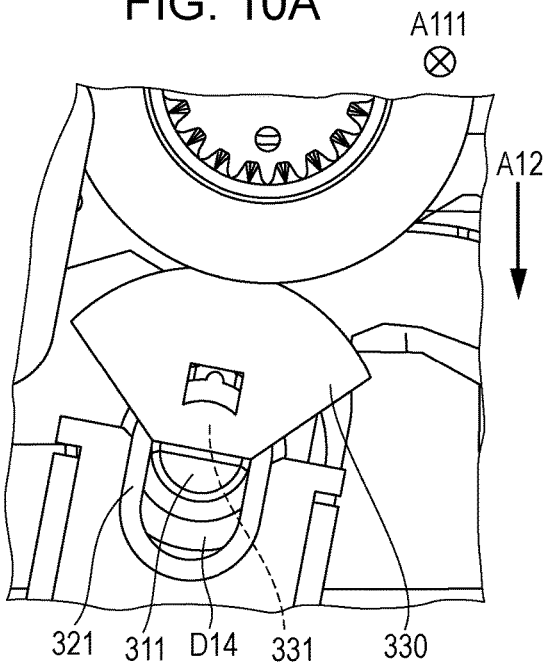
FIGS. 10A to 10D show a transition from a separated state to a pressed state.
Figure 10B:
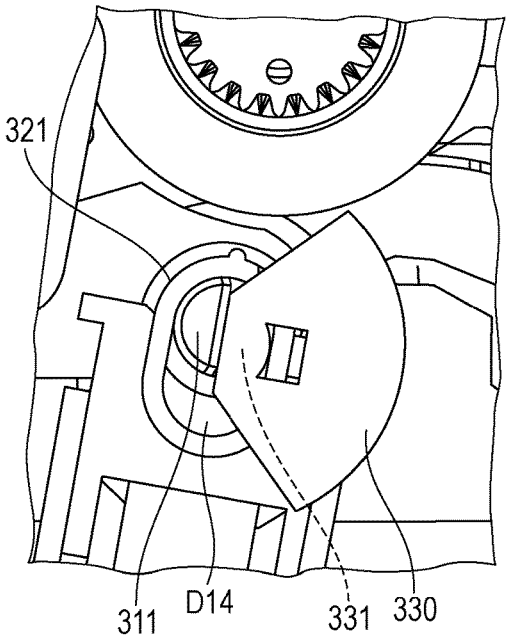

FIGS. 10A to 10D show a transition from a separated state to a pressed state. FIGS. 10A to 10D show the first shaft 310, the first bearing 320, the first switching member 330, and the photoconducting part 21, as viewed in the inward direction A111. When the drum gear 212 rotates, the gear portion G332 meshing with the drum gear 212 and the entire first separating part 332 and first switching member 330 start to rotate. FIG. 10A shows the first switching member 330 in the separated state, and FIG. 10B shows a state in which, from the separated state, the first switching member 330 has rotated by 90 degrees, and as a result, the drum gear 212 and the gear portion G332 do not mesh with each other.

Before reaching this state, because the first shaft part 331 is held between the cut-out part 311 and the first support part 321, the first switching member 330 rotates with the first shaft 310. In the state in FIG. 10B, the storage space D14 formed in the first support part 321 is positioned vertically below the first shaft part 331. Hence, the first shaft part 331 and the first switching member 330 start to move (that is, fall) toward the storage space D14 due to gravity.

Figure 10C:
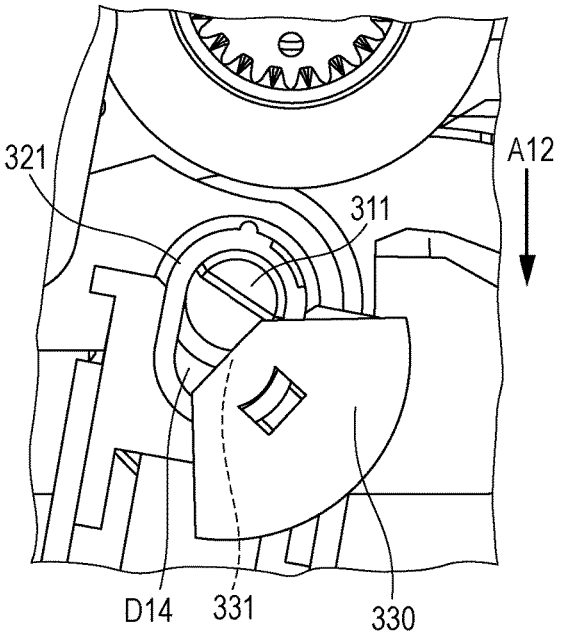

At this time, the photoconductor drum 211 that is no more supported by the first switching member 330 moves toward the first transfer roller 260 as it is urged toward the first transfer roller 260 as described above, and thus, a pressed state in which the photoconductor drum 211 and the first transfer roller 260 press each other is achieved. FIG. 10C shows a state in which the first shaft 310 has rotated by another approximately 90 degrees. In this state, not only the gravity, but also an urging force in the direction from the cut-out part 311 to the storage space D14 is applied to the first shaft part 331.

Figure 10D:
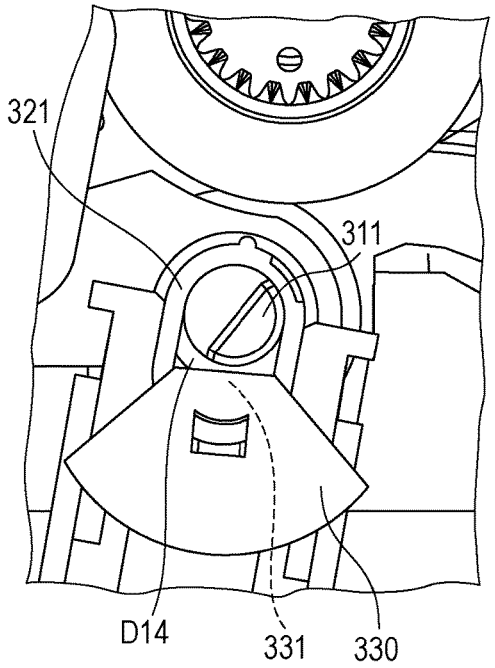

FIG. 10D shows a state in which the first shaft 310 has rotated by another approximately 90 degrees, and the first shaft part 331 and the first switching member 330 are completely stored in the storage space D14. When the first switching member 330 is stored in the storage space D14, even when the first shaft 310 rotates, the first switching member 330 does not touch the rotating first shaft 310.

As described above, in this example, the members (the first switching member 330 and the second switching member 430) that switch the state of the two rollers, namely, the first transfer rollers and the photoconductor drums, from the separated state to the pressed state are not in contact with the first shaft 310 after switching the state. The first bearing 320 forms the storage space D14 in a vertically downward direction with respect to the first shaft 310 when the image forming apparatus 1 is installed. Thus, compared with the case where the storage space D14 is formed in another direction, the first switching member 330 after movement more easily stays in the storage space D14.

Figure 11A:
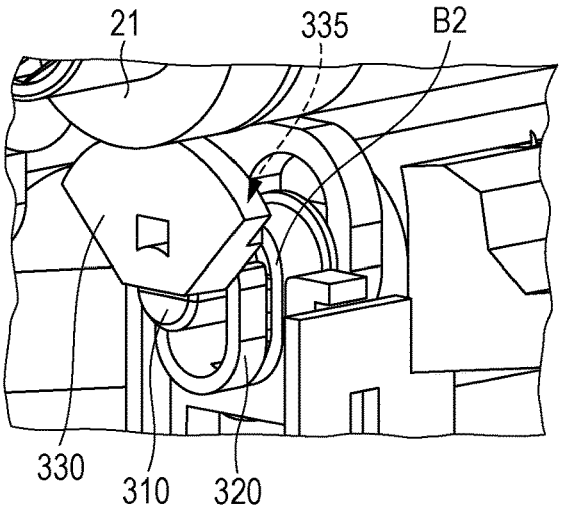
FIGS. 11A to 11C are perspective views showing a transition from the separated state to the pressed state.
Figure 11B:
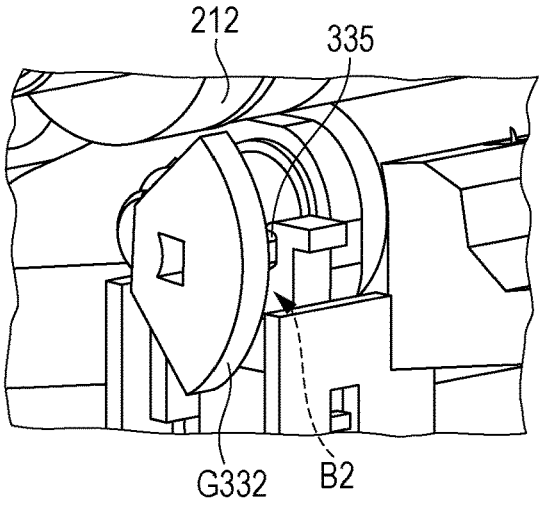
Figure 11C:
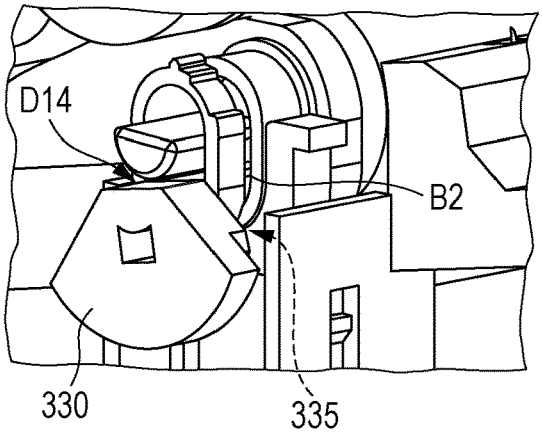

FIGS. 11A to 11C are perspective views showing a transition from the separated state to the pressed state. FIG. 11A shows the first shaft 310, the first bearing 320, the first switching member 330, and the photoconducting part 21 in the separated state. FIG. 11B shows a state in which the drum gear 212 and the gear portion G332 do not mesh with each other. FIG. 11C shows a state in which the first shaft part 331 and the first switching member 330 are completely stored in the storage space D14.

As described above, when the first shaft part 331 rotates with the first shaft 310 and moves from the cut-out portion B1 to the storage space D14, the first separating part 332 of the first switching member 330 comes out of contact with the photoconducting part 21 (more specifically, the drum gear 212), and thus, the state of the first transfer roller 260 and the photoconductor drum 211 is switched from the separated state to the pressed state, in which they press each other.

The inward surface 321-1 and the outward surface 321-2 of the first bearing 320, which constitute the slit B2, extend along the path along which the hook portion 335 moves when the first shaft part 331 moves from the cut-out portion B1 to the storage space D14. This path constitutes a portion of the slit B2. In other words, the hook portion 335 moves through this path, i.e., a portion of the slit B2.

As described above, when the first switching member 330 is disposed such that a gap is produced between the outward surface 335-1 of the hook portion 335 and the inward surface 321-1 of the first bearing 320 and such that a gap is produced between the inward surface 335-2 of the hook portion 335 and the outward surface 321-2 of the first bearing 320 in the task before dispatch, unless a force in the outward direction A112 is applied to the first switching member 330, the hook portion 335 moves through this path without allowing the outward surface 335-1 and the inward surface 335-2 to touch the surface of the first bearing 320. Thus, the hook portion 335 and the first bearing 320 are prevented from rubbing each other and thus inhibiting smooth movement of the first switching member 330.

Switching from the separated state to the pressed state is also performed by the second switching member 430. A cut-out portion provided in the second shaft 410 of the second switching member 430 is an example of a "second cut-out portion" of the present invention, and the second bearing 420 is an example of a "second bearing" of the present invention. A shaft part of the second switching member 430 is an example of a "second shaft part" of the present invention, and a separating part is an example of a "second separating part" of the present invention.

In the separated state, the first switching member 330 is held between the cut-out part 311 and the drum gear 212 and receives forces therefrom, the first switching member 330 does not move in the axial direction A11 due to the friction with the cut-out part 311 and the drum gear 212. However, when the first switching member 330 is separated from the gear portion G332 and the drum gear 212, the friction is eliminated. Then, as shown in FIGS. 11A to 11C, the first shaft part 331 of the first switching member 330 moves to the storage space D14, with the hook portion 335 of the first arm part 333 moving through the slit B2 in the first support part 321.

When the first switching member 330 is going to move in the axial direction A11, the hook portion 335 comes into contact with the first bearing 320, inhibiting the first switching member 330 from moving outward of the axial direction A11. The hook portion 335 is an example of a "first contact portion" of the present invention. The hook portion 335 provided on the first switching member 330 prevents the first switching member 330 from moving in the axial direction A11 and falling off while the first shaft part 331 is moving to the storage space D14. Because the hook portion 335 is provided on the first switching member 330, at a position on the inner side, in the axial direction A11, of the end surface 330-1 facing outward of the axial direction A11, the first switching member 330 is prevented from falling off, without any member provided on the outer side of the first switching member 330 in the axial direction A11.

Figure 12:
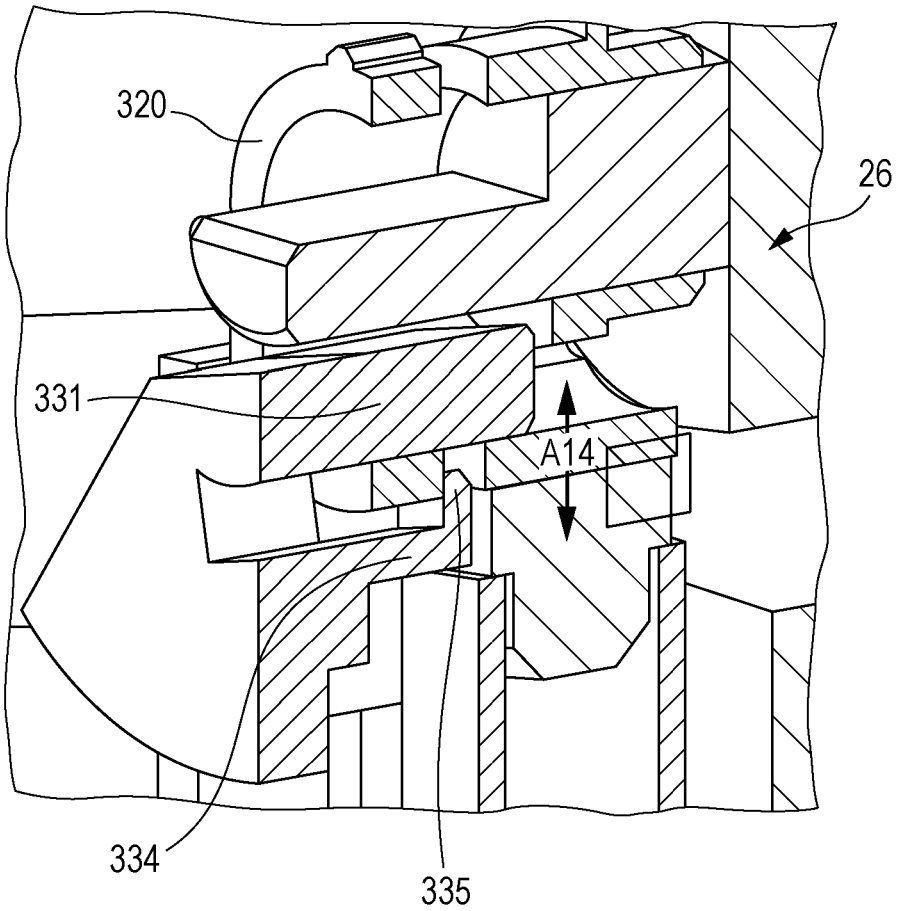
FIG. 12 is a sectional view of the first switching member and the first bearing after movement.

FIG. 12 is a sectional view of the first switching member 330 and the first bearing 320 after the movement. When the image forming apparatus 1 is used for a long time, the first transfer part 26 may be replaced due to wear of the surface of the first transfer roller 260 or other reasons. During the replacement, not only a force in the axial direction A11, but also a force in a direction A14 of the first bearing 320 may be applied to the first transfer part 26. Even in that case, the first support part 321 of the first bearing 320 is held between the longitudinal portion 334 of the first arm part 333 and the first shaft part 331 in the thickness direction A14.

Hence, when the first switching member 330 is going to move in the thickness direction A14, the longitudinal portion 334 and the first shaft part 331 come into contact with the first bearing 320 and prevents the first switching member 330 from moving in the thickness direction A14. The longitudinal portion 334 and the first shaft part 331 are an example of a "second contact portion" of the present invention. The longitudinal portion 334 and the first shaft part 331 provided on the first switching member 330 prevent the first switching member 330 from moving in the thickness direction A14 and falling off when, for example, the first transfer part 26 is replaced.

In this example, the first separating part 332 is in contact with the photoconducting part 21 at the arc-shaped portion (gear portion G332). This allows the first separating part 332 to more smoothly rotate with the photoconductor drum 211 than in the case where the portion in contact with the first transfer part 26 (hereinbelow, a "contact portion") does not have an arc shape. In this example, the contact portion has teeth that mesh with the drum gear 212 of the photoconducting part 21.

This configuration reduces slippage between the rotating photoconducting part 21 and the first separating part 332, compared with the case where the contact portion of the first separating part 332 does not have teeth meshing with the drum gear 212. In this example, the drum gear 212 rotated by the power transmitted from the driving part of the photoconductor drum 211 is in contact with the first separating part 332. This configuration does not require a separate driving part for rotating the first separating part 332.

In this example, the cut-out portion B1 is formed by D-cutting. Hence, the contact portions of the first shaft 310 and the first switching member 330 in the separated state are flat. Depending on the machining accuracy, if the contact portions are curved or have irregularities, a gap is more likely to be formed between the contact portions than in the case where the contact portions are flat. In other words, in this example, by providing a flat cut surface in the first shaft 310 by D-cutting, a gap is less likely to be formed between the contact portions of the switching member 330 and the first shaft 310 than in the case where the first shaft 310 has another shape.

In this example, the first shaft 310 has, at the contact portion, the cut surface C311-1 extending through the rotation axis E1. The cut surface C311-1 has a maximum area when it is flat. With this configuration, the area of the cut surface is larger than that in the case where the plane of the shaft does not extend through the rotation axis, and thus, the stability of the switching member disposed in the cut-out portion B1 in the separated state is improved.

2. Modifications

The above-described example is merely an example of the present invention and may be modified as follows. The example and the modifications may be implemented in combination, as necessary.

2-1. Cut-Out Portion

The shape, position, and size of the cut-out portion may be different from those in the example. Although the cut-out portion B1 in the example has a semicylindrical shape obtained by cutting a cylinder along a plane extending through the rotation axis, for example, the position of the plane may be shifted from the plane extending through the rotation axis. The position of the plane may be shifted either in a direction in which the cut-out portion becomes small or in a direction in which the cut-out portion becomes large.

Furthermore, the surface between the cut-out portion and the cut-out part of the shaft may be curved or irregular, not flat. In that case, the shaft part of the switching member disposed in the cut-out portion is less likely to shift than in the case where the surface at the boundary is flat. The cut-out portion may be formed not at the distal end of the shaft, but in the middle of the shaft. Even in that case, the cylinder portion on the distal-end side of the shaft does not prevent the rotation of the switching member unless the switching member moves in the axial direction of the shaft.

The size of the cut-out portion may be larger than that in the example. For example, when the radius of the cut-out portion is larger than the radius of the shaft part of the switching member, a gap is formed between the shaft part and the bearing. In that case, the arm part and the slit only need to prevent the switching member from falling off. Furthermore, if the axial length of the cut-out portion is larger than the axial length of the switching member, the distal end of the shaft projects further in the axial direction than the switching member. This projection also does not prevent the rotation of the switching member.

If the axial length of the cut-out portion is smaller than the axial length of the switching member, the switching member projects further in the axial direction than the shaft. In that case, the bending moment generated in the switching member due to the load from the photoconducting part 21 is larger than that in the example. Hence, the switching member needs to be strong enough to resist the bending moment.

2-2. Separating Part

The shape, size, and position of the separating part may be different from those in the example. For example, the separating part does not need to have gear teeth on the arc-shaped contact portion, at which the separating part is in contact with the photoconducting part 21. Even if this contact portion is a curved surface with no projections and recesses, when the photoconducting part 21 rotates, the separating part also rotates due to the friction with the photoconducting part 21, eliminating the separated state.

The contact portion with respect to the photoconducting part 21 does not need to have an arc shape. For example, the separating part may have a rectangular parallelepiped shape and the contact portion may be flat. In that case, when the photoconducting part 21 rotates, the separating part rotates due to friction. First, the photoconducting part 21 moves away from the first transfer roller, and, when the contact portion climbs over one edge the rectangular parallelepiped, the photoconducting part 21 moves toward the first transfer roller, and thus, the state is switched to the pressed state.

The separating part may be provided so as to be in contact with the photoconductor drum, an end that is not used for image formation. More specifically, the separating part only needs to be sized, positioned, and shaped so as to come into contact with the photoconducting part to separate the photoconductor drum and the first transfer roller when the shaft part is disposed in the cut-out portion, and so as to rotate with the shaft and come out of contact with the photoconducting part to bring the photoconductor drum and the first transfer roller into the pressed state.

2-3. Storage Space

The storage space formed in the bearing may differ in shape, size, and position from the storage space in the example. The storage space may of course be larger than the storage space in the example, and, if the switching member is smaller than that in the example, the storage space may be made smaller until it is appropriate for storing the switching member. In other words, the storage space needs to be shaped and sized so as to bring the switching member stored in the space out of contact with the shaft.

In the example, the bearing forms a storage space in a vertically downward direction with respect to the shaft when the image forming apparatus 1 is installed. However, the configuration is not limited thereto, and, the storage space may be formed in another direction with respect to the shaft. For example, when the photoconductor drum and the first transfer roller are disposed side-by-side in the horizontal direction, the bearing forms a storage space on the opposite side, in the horizontal direction, of the shaft from the photoconductor drum.

In that case, in the separated state, because the switching member is held between the photoconducting part and the shaft and receives forces therefrom, the friction prevents the switching member from falling vertically downward, and the separated state is maintained. When the switching member rotates with the photoconducting part and comes out of contact with the photoconducting part, as shown by the example shown in FIGS. 10B and 10C, the switching member is pushed by the cut-out part of the shaft and moves to the storage space. This way, the bearing only needs to form a storage space at a position to which the switching member is moved when the photoconducting part and shaft are rotated.

2-4. Switching Member

In the example, although the switching members are provided on both ends of the first transfer roller 260, the switching member may be provided only on one end thereof. For example, a switching member that switches the state from the separated state to the pressed state by using two helical gears may be provided at the other end. Even in that case, because the switching member of the present invention is provided at one end, the member that switches the state of the two rollers from the separated state to the pressed state becomes out of contact with the shaft at the one end after switching.

2-5. Roller Unit

In the example, although the present invention is applied to roller units having the first transfer rollers, the present invention may also be applied to, for example, roller units having photoconductor drums or a roller unit having the second transfer roller and the backup roller. If the fixing part has two rollers, the present invention may be applied to roller units having one of the two rollers. Furthermore, the present invention may be applied to roller units of an apparatus other than an image forming apparatus (e.g., a transport apparatus or a post-processing apparatus). The present invention may be applied to any roller unit that requires switching of the state of the two rollers from a separated state to a pressed state.

2-6. Bearing

In the example, the plane bearing supports the first transfer roller so as to allow rotation thereof. However, the bearing is not limited to the plain bearing and may be a rolling bearing (ball bearing), a magnetic bearing, a fluid bearing, or the like. In that case, a portion in which a storage space is formed, such as the first support part 321, and a portion that supports a roller so as to allow rotation thereof, such as the second support part 322, need to be formed.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A roller unit comprising:

a first roller including, at one end, a shaft having a cut-out portion;

a bearing configured to support the shaft and form a space for accommodating an object disposed in the cut-out portion; and a switching member including a shaft part configured to be disposed in the cut-out portion, and a separating part that is continuous with the shaft part and that is configured, in a case where the shaft part is disposed in the cut-out portion, to come into contact with a unit including a second roller to separate the first roller and the second roller, wherein the separating part is configured, in a case where the shaft part rotates with the shaft and moves from the cut-out portion to the space, to come out of contact with the unit, bringing the first roller and the second roller into a state in which the first roller and the second roller push each other.

2. The roller unit according to claim 1, wherein the switching member is movable relative to the bearing and the shaft in an axial direction of the shaft and has a first contact portion configured to come into contact with the bearing to prevent the switching member from moving outward in the axial direction.

3. The roller unit according to claim 2, wherein the first contact portion is provided on an axially inner side of an end surface of the switching member facing axially outward and has a first surface facing axially outward, the bearing has, at a position facing the first surface, a second surface facing axially inward in a state in which the first roller and the second roller are separated, and the first surface and the second surface are configured, in a case where the first contact portion comes into contact with the bearing, to come into contact with each other.

4. The roller unit according to claim 1, wherein the switching member includes a second contact portion configured, in a case where the switching member is going to move in a thickness direction of the bearing, to come into contact with the bearing to prevent a movement of the switching member in the thickness direction.

5. The roller unit according to claim 1, wherein the separating part is further configured to come into contact with the unit at an arc-shaped portion thereof centered at an axis common to the shaft.

6. The roller unit according to claim 5, wherein the unit including the second roller has a gear at the one end, and the separating part has, on the arc-shaped portion, teeth configured to mesh with the gear.

7. The roller unit according to claim 6, wherein the gear provided in the unit including the second roller is configured to be rotated by a power supplied from a driving part of the second roller.

8. The roller unit according to claim 1, wherein, in a state in which the switching member separates the first roller and the second roller, the shaft is disposed on an opposite side of the separating part from the unit.

9. The roller unit according to claim 1, wherein the bearing is further configured, in a case where an image processing apparatus having the bearing is installed, to form the space in a vertically downward direction with respect to the shaft.

10. The roller unit according to claim 1, wherein the cut-out portion in the shaft has a flat cut surface formed by D-cutting, and the shaft part has a flat surface configured, in a case in which the shaft part is disposed in the cut-out portion, to come into contact with the cut surface.

11. The roller unit according to claim 10, wherein the cut surface is a plane extending through a rotation axis of the shaft.

12. The roller unit according to claim 1, wherein the first roller has, at another end, a second shaft having a second cut-out portion, a second bearing configured to support the second shaft and form a second space for accommodating an object disposed in the second cut-out portion, a second switching member including a second shaft part that can be disposed in the second cut-out portion, and a second separating part that is continuous with the second shaft part and that is configured, in a case where the second shaft part is disposed in the second cut-out portion, to come into contact with the unit including the second roller to separate the first roller and the second roller, and the second separating part is further configured, in a case where the second shaft part rotates with the second shaft and moves from the second cut-out portion to the second space, to come out of contact with the unit, bringing the first roller and the second roller into a state in which the first roller and the second roller push each other.

13. An image forming apparatus comprising:

the roller unit according to claim 1;

a unit including a photoconductor, configured to serve as the second roller;

a transfer belt; and an image forming section configured to form an image by forming an image on the second roller, apply a transfer voltage to the first roller and the second roller to transfer the formed image to the transfer belt, and transfer the image transferred to the transfer belt to a medium.

* * * * *